United States Patent [19]

Haller

[11] 4,065,037

[45] Dec. 27, 1977

[54] NON-SPURTING TWIST-OPEN DISPENSING CLOSURE

[75] Inventor: Thomas L. Haller, Cincinnati, Ohio

[73] Assignee: The Procter & Gamble Company, Cincinnati, Ohio

[21] Appl. No.: 705,725

[22] Filed: July 15, 1976

[51] Int. Cl.[2] ..... B65D 47/26

[52] U.S. Cl. ..... 222/153; 222/521

[58] Field of Search ..... 222/519–521, 222/549, 153

[56] References Cited

U.S. PATENT DOCUMENTS

| | | | |
|---|---|---|---|
| 3,317,093 | 5/1967 | Moran | 222/549 X |
| 3,370,764 | 2/1968 | Stull | 222/521 X |
| 3,820,683 | 6/1974 | Jasinski | 222/153 X |
| 3,901,410 | 8/1975 | Schultz | 222/521 X |
| 3,977,557 | 8/1976 | Hazard | 222/153 |
| 3,981,421 | 9/1976 | McDowell, Jr. et al. | 222/521 |
| 3,991,908 | 11/1976 | Thomas et al. | 222/153 X |

*Primary Examiner*—Stanley H. Tollberg
*Assistant Examiner*—Charles A. Marmor
*Attorney, Agent, or Firm*—Melville, Strasser, Foster & Hoffman

[57] ABSTRACT

A two-piece, non-spurting dispensing closure for a bottle or other appropriate container of the type having a finish or neck. The closure comprises a shell for engagement with the neck or finish of the bottle or container. The shell has an upstanding cylindrical chimney and a pair of upstanding diametrically opposed posts to either side of and spaced from the chimney. A tip is rotatively and telescopically mounted on the chimney and is shiftable between an extended open position and a retracted closed position. The interior of the tip is provided with a pair of thread segments and a pair of inclined planes, one thread segment and one inclined plane of each pair cooperating with one of the shell posts to serve as an elevating and lowering mechanism apart from the chimney to shift the tip between its open and closed positions upon limited rotation of the tip with respect to the shell. The interior of the tip also has stops to positively define the open and closed positions of the tip. The engagement of the shell with the neck or finish of the bottle or container may be such as to prevent removal of the shell from the neck or finish. The thread segments may be configured to render the closure tip child-resistant. The entire closure may be provided with an overcap.

12 Claims, 17 Drawing Figures

NON-SPURTING TWIST-OPEN DISPENSING CLOSURE

BACKGROUND OF THE INVENTION

1. Field of the Invention

The invention relates to a non-spurting dispensing closure and more particularly to such a closure comprising a shell and a tip with an elevating and lowering mechanism apart from the shell chimney and stop means whereby the tip may be shifted between positively defined open and closed positions by limited twisting thereof with respect to the shell.

2. Description of the Prior Art

The dispensing closure of the present invention, comprising a shell and a tip, is applicable to any appropriate type of container having a neck or finish with which the shell may be engaged. The term "container," as used herein and in the claims, is to be interpreted as being inclusive of glass or plastic bottles, metallic cans and the like. While the shell of the dispensing closure of the present invention will be illustrated, for purposes of an exemplary showing, as being internally threaded for a threaded engagement with the neck or finish of the container, other methods of engagement between the shell and the neck or finish of the container may be employed without departing from the spirit of the present invention.

Prior art workers have devised many types of dispensing closures comprising a shell having an upstanding, substantially cylindrical chimney and a tip mounted on the chimney and shiftable with respect thereto between an open and a closed position. For example, a dispensing closure with a tip having a push-pull relationship with the chimney of the shell has found great utility in connection with the dispensing of many fluids. This is true because such closures are relatively inexpensive to manufacture, reliable, and easy to operate. The captive nature of the tip with respect to the shell eliminates the requirement of a separate cap means.

Prior art workers have also devised "twist-open" dispensing closures having a tip member threaded onto the chimney of the shell. Such twist-open dispensing closures, however, due to the necessity for full threads thereon, generally are expensive to mold in that the dye member forming the threads must be unscrewed from the molded part. Such closures are also less convenient for the user than push-pull type closures because of the large amount of twist necessary to unscrew the tip member sufficiently to open the closure.

Push-pull closures have been highly satisfactory for dispensing numerous fluid substances such as, by way of example only and without limitation, liquid cleaning preparations. There have recently been developed, however, abrasive, liquid cleaning preparations which are thixotropic, having very high viscosity at low shear rates and which require that they be thoroughly mixed, as by shaking, immediately before use. Such cleaning preparations are disclosed, for example, in U.S. patent application Ser. No. 415,033, entitled LIQUID ABRASIVE CLEANER WITH HYPOCHLORITE BLEACH, filed Nov. 12, 1973 by W. L. Hartman, now U.S. Pat. No. 4,005,027 and assigned to the Procter and Gamble Company. When a push-pull closure was attempted to be utilized in connection with this thixotropic cleaner, following shaking thereof, it was found that a substantial quantity of the material was retained within the closure shell, and particularly within the passageway of the chimney, with the result that when the closure was opened by outward pull applied to the tip member, in most cases a small quantity of the product spurted outwardly from the dispensing opening.

In copending U.S. patent application Ser. No. 592,007, entitled NON-SPURTING DISPENSING CLOSURE, filed June 30, 1975, by John D. McDowell, Jr. and Paul J. Nutley, now U.S. Pat. No. 3,981,421 and assigned to the Procter and Gamble Company, an anti-spurt, push-pull type dispensing closure is described. Briefly, the dispensing closure comprises a shell having a substantially cylindrical chimney and a tip mounted on the chimney and shiftable between a retracted closed position and an extended open position. The chimney is provided with angled ribs on its exterior surface and the tip is provided with cooperating lugs on its interior to provide a limited degree of relative rotation between the tip and the chimney during the shifting of the tip between its open and closed positions. It has been found that this construction prevents spurting upon opening of the closure after shaking of the contents to be dispensed.

The present invention is directed to a twist-open, anti-spurt, dispensing closure which, while not so limited in use, is particularly adapted for the dispensing of viscus or thixotropic material requiring shaking immediately prior to dispensing, such as the liquid cleaning preparations described above. The dispensing closure of the present application comprises a shell with a chimney and a tip so constructed that a limited twisting of the tip with respect to the chimney is required to shift the tip between its open and closed positions. The closure is inexpensive to manufacture in that it does not require full threads on the tip or the shell requiring the dye member forming these parts to be unscrewed therefrom. The amount of twisting required to open the closure is far less than that encountered with the conventional twist-open dispensing closures.

The dispensing closure of the present invention is reliable in operation, durable, and capable of dispensing abrasive liquids and the like. The tip may be snap-fit assembled to the shell and is captively held thereon. Finally, means may be provided to prevent removal of the shell from the container to which it is attached and additional means may be provided to render the dispensing closure child-resistant.

SUMMARY OF THE INVENTION

The two-piece, non-spurting dispensing closure of the present invention comprises a shell for engagement with the neck or finish of a container. The shell has an upstanding cylindrical chimney and a pair of upstanding, diametrically opposed posts spaced to either side of the shell chimney.

A tip is provided and is both rotatively and telescopically mounted on the chimney. The top is shiftable between an extended open position and a retracted closed position. The tip is provided with an annular rib adapted to be located in an annular groove in the exterior surface of the shell chimney to render the tip captive with respect to the chimney. Additional ribs on the interior surface of the tip form seals with the exterior surface of the chimney.

The interior of the tip is also provided with a pair of thread segments and a pair of inclined planes. Each thread segment is located in an appropriately configured notch in one of the shell posts. Each inclined plane rides upon a corner of one of the shell posts. Thus, the shell posts, the thread segments and inclined planes of the tip cooperate to serve as an elevating and lowering mechanism for the tip (apart from the chimney) between the open and closed positions of the tip. Stop means are also provided within the tip and cooperate with the shell posts to positively define the open and closed positions of the tip.

Means may be provided to prevent disengagement of the shell from the neck or finish of the container with which it is engaged. In addition, the thread segments of the tip may be so configured as to render the closure tip child-resistant, all as will be described hereinafter. Finally, the dispensing closure of the present invention may be provided with an overcap.

DESCRIPTION OF THE PREFERRED EMBODIMENTS

Figure 1:
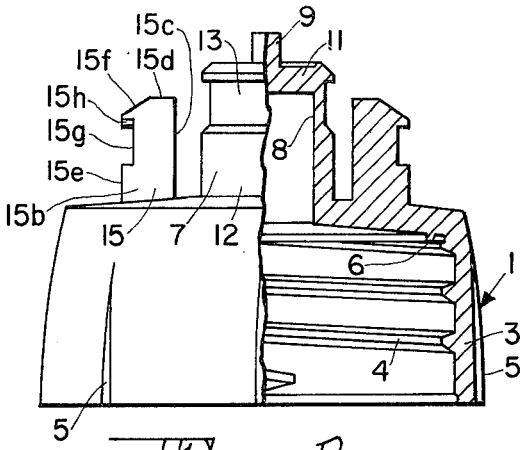
FIG. 1 is a side elevational view, partly in cross section, of the shell of the present invention.
Figure 2:
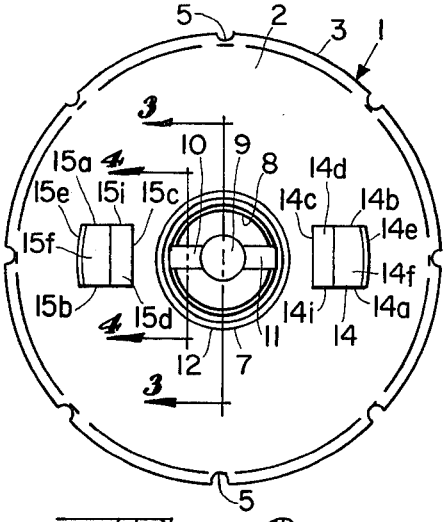
FIG. 2 is a plan view of the shell of FIG. 1.
Figure 3:
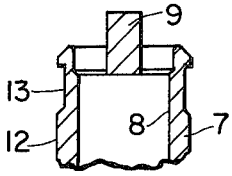
FIG. 3 is a fragmentary cross sectional view taken along section line 3—3 of FIG. 2.
Figure 4:
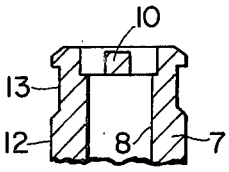
FIG. 4 is a fragmentary cross sectional view taken along section line 4—4 of FIG. 2.

The shell portion of the dispensing closure of the present invention is illustrated in FIGS. 1 through 5 wherein like parts have been given like index numerals. The shell is generally indicated at 1 having a top portion 2 and a downwardly depending annular portion or skirt 3. The inside surface of the annular portion 3 is provided with threads for adapted to mate and engage corresponding threads on the neck or finish of a container (not shown). As indicated above, means other than threading (as are known in the art) may be employed to engage the shell 1 with the neck or finish of a container, within the scope of the present invention. The outside surface of the annular shell portion 3 may, if desired, be provided with generally parallel grooves, ridges or the like both for decorative purposes and to facilitate grasping of the shell for threading it onto the container finish. By way of example, parallel grooves 5 are illustrated in FIGS. 1 and 2. The interior surface of top portion 2 may have a downwardly depending annular rib 6 intended to abut and form a seal with the top end of the container finish.

As is clearly shown in FIGS. 1 through 4, a chimney 7 is located centrally of the top portion 2 of shell 1. The chimney 7 is generally cylindrical in configuration and is provided with an axial bore 8, open at its lower end to communicate with the interior of the container and open at its upper end for dispensing of the contents of the container, the bore 8 serving as a dispensing passageway.

At its uppermost end, the chimney 7 is provided with a cylindrical closure plug 9 coaxial with bore 8 and supported by diametrically opposed bridge members 10 and 11. Bridge members 10 and 11 and closure plug 9 may constitute one piece, integral portions of chimney 7. It will be understood that other mounting means for closure plug 9 may be employed, as for example a generally continuous annulus with apertures therethrough surrounding the closure plug 9.

The exterior surface 12 of chimney 7 is smooth and continuous. At its upper end the exterior surface of the chimney has an annular groove 13 formed therein. The purpose of this groove will be set forth hereinafter.

The top portion 2 of the shell is provided with a pair of identical, diametrically opposed posts 14 and 15, to either side of the chimney 7 and spaced therefrom.

Figure 5:
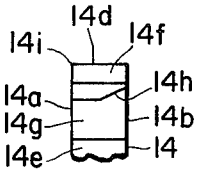
FIG. 5 is a fragmentary elevational view of the right hand post of the shell of FIGS. 1 and 2 as viewed from the right in those figures.
Figure 6:
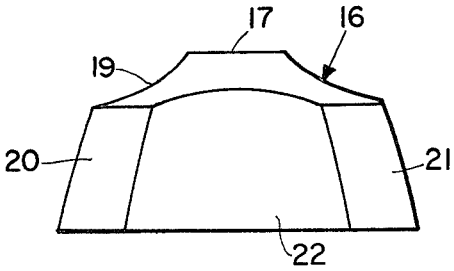
FIG. 6 is a side elevational view of the tip of the present invention.
Figure 7:
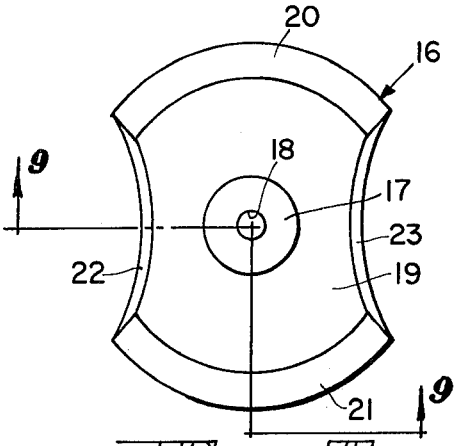
FIG. 7 is a plan view of the tip of FIG. 6.

Since posts 14 and 15 are identical, it will suffice to describe post 14, most clearly illustrated in FIGS. 1, 2 and 5. Post 14 is an upstanding member having flat side surfaces 14*a* and 14*b*, a flat rear surface 14*c* and an essentially flat top surface 14*d*. The forward surface 14*e* is arcuate about a vertical axis to cooperate with the curved inside surface of the tip, as will be evident hereinafter. Between the forward surface 14*e* and the top surface 14*d* there is a clearance surface 14*f* which slopes downwardly and outwardly. The forward surface 14*e* is provided with a notch 14*g* which is relieved at 14*h* in the upper right hand corner of the notch 14*g*, as viewed in FIG. 5. The notch 14*g* and relief 14*h* are configured to accommodate a thread segment in the tip, as will be evident hereinafter. The upper left hand edge 14*i* of the post, defined by the juncture of the top surface 14*d* and the side surface 14*a* will be contacted by one of the inclined planes of the tip, as will be evident hereinafter, and to prevent wear of the parts the edge 14*i* is preferably rounded. Corresponding parts of identical post 15 are indicated in FIGS. 1 and 2 by the index numeral 15 followed by a corresponding letter.

The tip of the closure of the present invention is illustrated in FIGS. 6 through 11 wherein like parts have been given like index numerals. The tip is generally indicated at 16. The top of the tip has a first, substantially flat, central, annular portion 17 surrounding a dispensing opening 18. The top of the tip has a second portion 19 surrounding the portion 17 and the curving gently downwardly and outwardly. The top portion 19 terminates in downwardly and outwardly curved skirt portions 20 and 21. While skirt portions 20 and 21 could form a single, integral, continuous, circular skirt about top portion 19, they are preferably interrupted by diametrically opposed upwardly and inwardly sloping skirt portions 22 and 23 which curve slightly inwardly toward the axis of dispensing opening 18. This configuration facilitates grasping of the tip by the user (at skirt portions 22 and 23) to impart a twisting motion thereto for opening or closing the dispensing closure.

Interiorly (see FIGS. 8 through 11) the tip 16 has a downwardly depending cylindrical wall 24 having an inside diameter slightly greater than the outside diameter of the smooth exterior surface 12 of chimney 7. The interior surface of cylindrical wall 24 carries an annular retaining rib 25 and a pair of annular sealing ribs 26 and 27, the purpose of which will be described hereinafter. The outside surface of the cylindrical wall may taper slightly downwardly to facilitate removal of the tip from the mold in which it is formed.

Returning to FIG. 8 the cylindrical wall 24 is connected to the skirt portions of the tip by radially oriented reinforcing webs. Web 28 extends from the cylindrical wall 24 to a point at about the juncture of skirt portions 21 and 22. Similarly, web 29 extends from the cylindrical wall 24 to a point at about the juncture of skirt portions 21 and 23. Web 30 is diametrically opposed to web 29 and extends from the cylindrical wall 24 to a point substantially at the juncture of skirt portions 20 and 22 while web 31 is diametrically opposed to web 28, extending between wall 24 and a point substantially at the juncture of skirt portions 20 and 23. Additional radial webs 32 and 33 extend from cylindrical wall 24 to skirt portions 22 and 23, respectively. The webs 28 through 31 present stop surfaces **28*a* through 31*a* which cooperate with the posts 14 and 15**, as will be described hereinafter.

Figure 8:
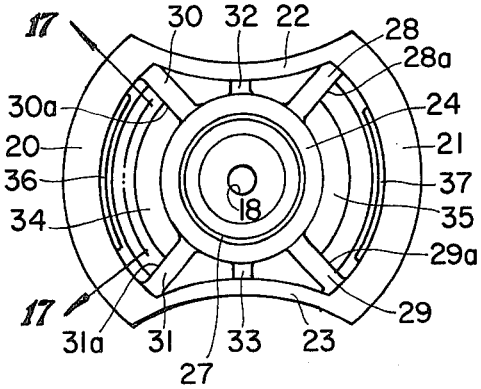
FIG. 8 is a bottom view of the top of FIGS. 6 and 7.
Figure 9:
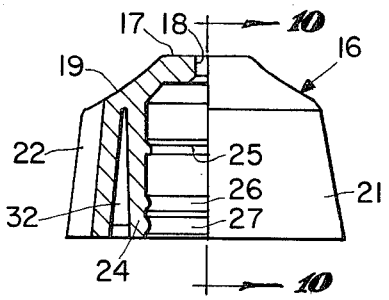
FIG. 9 is a partial cross sectional view taken along section line 9—9 of FIG. 7.
Figure 11:
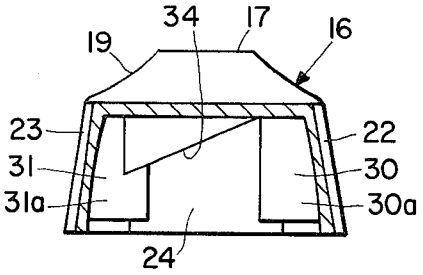
FIG. 11 is a cross sectional view taken along section line 11—11 of FIG. 10.

As is most clearly shown in FIGS. 8 and 11 there is, adjacent cylindrical wall 24, as arcuate inclined plane 34. The lower end of inclined plane 34 terminates at stop surface **31*a* of web 31 and the upper end terminates at stop surface 30*a* of web 30. Inclined plane 34 will cooperate with the post 15 on shell 1, as will be described hereinafter. In similar fashion a second inclined plane 35 is located adjacent cylindrical wall 24 and between webs 28 and 29. The lower end of inclined plane 35 terminates at stop surface 28*a* of web 28 while the upper end of inclined plane 35 terminates at stop surface 29*a* of web 29. The inclined plane 35 is intended to cooperate with post 14 of shell 1**, again as will be described hereinafter.

Figure 10:
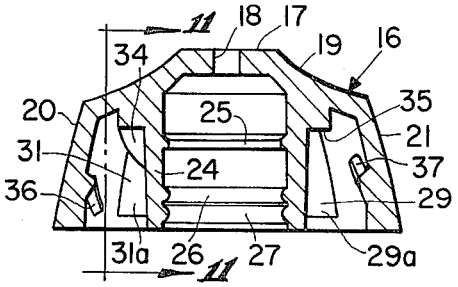
FIG. 10 is a cross sectional view taken along section line 10—10 of FIG. 9.

Referring particularly to FIGS. 8 and 10, the arcuate interior surface of skirt portion 20 is provided with a thread segment 36 adapted to cooperate with notch **15*g* and relief 15*h* of shell post 15. The thread segment 36 parallels the inclined plane 34 in that its lower end is that end nearest web stop surface 31*a* and its upper end is that end nearest web stop surface 30*a*. The arcuate interior surface of skirt portion 21 is provided with a similar thread segment 37 adapted to cooperate with notch 14*g* and relief 14*h* of shell post 14. The thread segment 37 parallels the inclined plane 35 so that its lower end is that end nearest web stop surface 28*a* while its upper end is that end nearest web stop surface 29*a***.

The shell 1 and the tip 16 each constitute integral, one-piece molded members. The shell and the tip may be molded of material of relatively differing hardness and resilience. For example, the shell member 1 may be molded of a relatively rigid material such as polystyrene. The tip 16, on the other hand, may be molded of a somewhat softer, more resilient material such as low density polyethylene. This enables the tip 16 to be ejected from its mold core without unscrewing or the like and enables a snap fit assembly of the tip 16 onto the shell 1. Furthermore, the materials of the shell 1 and tip 16 may be of differing thermal coefficients of expansion such that if they are assembled while still hot, the snap fit is more readily achieved.

Figure 12:
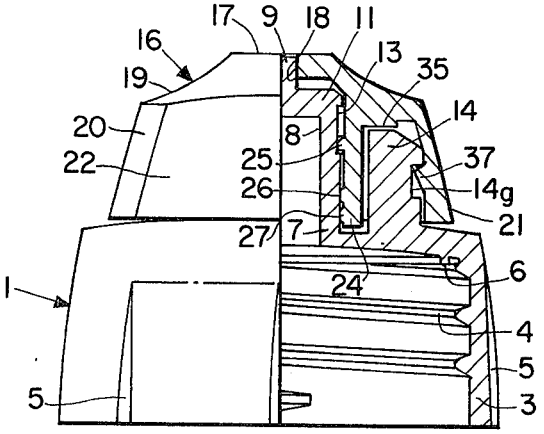
FIG. 12 is an elevational view of the closure of the present invention, partly in cross section and illustrating the tip in its retracted and closed position.

A comparison of FIGS. 2 and 8 will make it evident that in order to accomplish the snap fit assembly of the tip 16 to the shell 1 it is only necessary to locate the tip above the shell with the chimney 7 of the shell extending into the cylindrical wall 24 of the tip, the post 14 of the shell extending into that cavity of the tip defined by cylindrical wall 24, stop surfaces **28*a* and 29*a* and skirt portion 21, and shell port 15 extending into that cavity of the tip defined by cylindrical wall 24, stop surfaces 30*a* and 31*a* and skirt portion 20. Turning to FIG. 12 wherein like parts have been given like index numerals, it will be evident that upon a downward pressure being applied to the tip, the retaining rib 25 on the interior surface of the tip cylindrical wall 24 will snap into the annular groove 13 of the shell chimney 7. Similarly, thread segment 37 on skirt portion 21 of the tip will snap into engagement with slot 14*g* and relief 14*h* of shell post 14. When tip 16 is fully seated on shell 1 inclined plane 35 of the tip will engage the corner 14*i* of shell post 14. It will be understood by one skilled in the art that a similar engagement between the shell 1 and tip 16 will occur at shell post 15, the thread 36 of the tip snapping into engagement with the groove 15*g* and relief 15*h* of shell post 15 and the inclined plane 34 of the tip engaging the corner 15*i* of shell post 15**.

FIG. 12 illustrates the tip in its closed position. In this position, the notch **14*g* and relief 14*h* of shell post 14 are engaged by the uppermost end of tip thread segment 37. At the same time, the corner 14*i* of post 14 will be contacted by the uppermost portion of inclined plane 35. In similar fashion, the groove 15*g* and relief 15*h* of shell post 15 will engage the uppermost end of tip thread segment 36 while the upper corner 15*i* of shell post 15 will be contacted by the upper portion of the tip inclined plane 34. The closed position of tip 16 on shell 1 is positively determined by abutment of tip web stop surfaces 29*a* and 30*a* and the shell post sides 14*b* and 15*b***, respectively.

As will be evident from FIG. 12, when tip 16 is in its closed position with respect to shell 1, the tip is retracted with the bottom end of its cylindrical wall 24 approaching the top portion 2 of the shell, the tip retaining rib 25 approaching the bottom end of chimney groove 13 and the plug 9 telescoped within the tip dispensing opening 18, effectively closing the dispensing closure.

Figure 13:
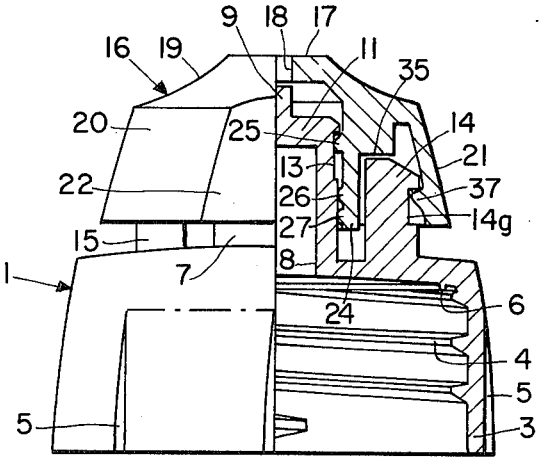
FIG. 13 is an elevational view, partly in cross section, similar to FIG. 12 and illustrating the tip in its fully opened position.

To open the dispensing closure it is only necessary to rotate the tip 16 a small amount in a counter clockwise direction with respect to the shell 1. The cooperation of tip thread segments 37 and 36 with post grooves **14*g* and 15*g*, respectively, together with the cooperation of inclined planes 35 and 34 with posts 14 and 15, respectively, will cause an elevation of tip 16 with respect to shell 1 until the tip reaches its open position as illustrated in FIG. 13. Like parts have been given like index numerals in FIG. 13 and it will be noted that post 14 now is engaged by the lower ends of thread segment 37 and inclined plane 35. In similar fashion post 15 will be engaged by the lower ends of thread segment 36 and inclined plane 34. The lowermost end of tip cylindrical wall 24 has shifted away from the top portion 2 of shell 1; the tip retaining rib 25 has approached the upper end of chimney groove 13; and plug 9 has been withdrawn from the dispensing opening 18** of the tip.

It will be noted that the sealing ribs 26 and 27 on the inside surface of the tip cylindrical wall 24 contact and form a seal with the smooth wall surface 12 of chimney 7 at all times. The retaining rib 25 of the tip, located within groove 13 of the chimney 7, will assure that the tip cannot be inadvertently disengaged from the shell by a vertical pulling force. Furthermore, the tip cannot be "cammed" from engagement with the shell by the interaction of the tip thread segments and the inclined planes with the shell posts since the open position of the tip with respect to the shell will be firmly determined by abutment of web stop surfaces **29*a* and 30*a* against shell post sides 14*a* and 15*a*, respectively. To return the tip to its closed position with respect to the shell, a clockwise rotation is imparted to the tip until the tip stop surfaces 28*a* and 31*a* engage the shell post sides 14*b* and 15*b***, respectively.

Figure 14:
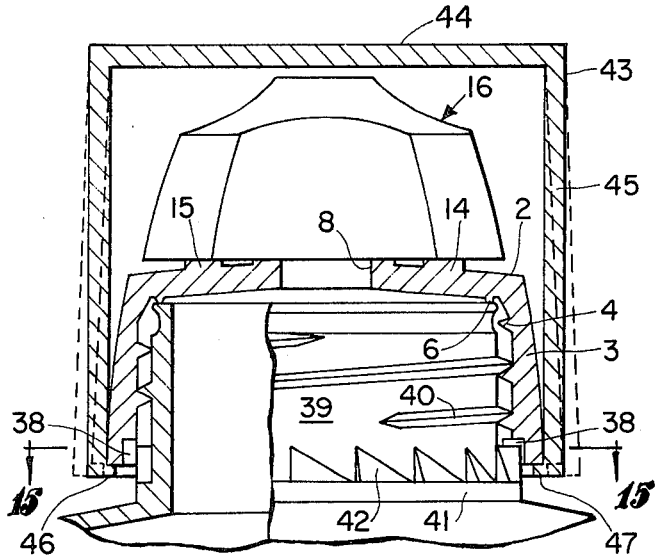
FIG. 14 is a fragmentary elevational view, partly in cross section, illustrating a container and its finish, an embodiment of the closure of the present invention and an overcap, the container finish and the shell being provided with rachet means to prevent disengagement of the shell therefrom.
Figure 15:
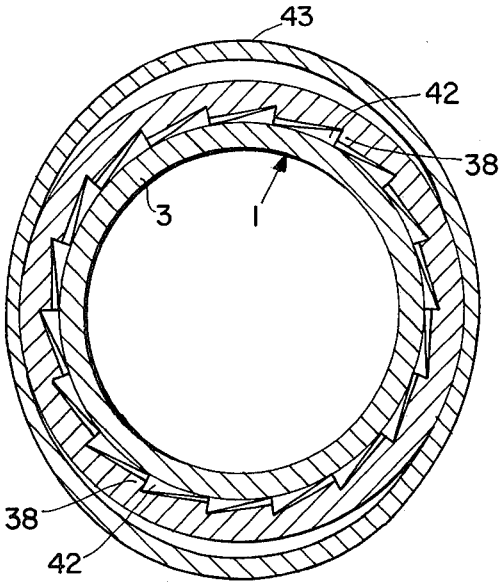
FIG. 15 is a cross sectional view taken along section line 15—15 of FIG. 14.

FIGS. 14 and 15 illustrate an embodiment of the dispensing closure of the present invention wherein once the shell has been threaded onto the finish of the container, it cannot be removed. The tip of FIG. 14 is identical to the tip illustrated in FIGS. 6 through 11 and like parts have been given like index numerals. Similarly, the shell of FIGS. 14 and 15 is substantially identical to the shell illustrated in FIGS. 1 through 5 and again like parts have been given like index numerals. The shell differs from that illustrated in FIGS. 1 through 5 only in that its lowermost inside surface is provided with a plurality of inclined teeth 38. In FIGS. 14 and 15 a container finish is shown at 39, threaded as at 40 to engage the threads 4 of shell 1. The finish 39 is provided with a base portion 41 having a series of inclined teeth 42 oriented oppositely from the teeth 38 of shell 1. The sides of the shell teeth 38 and the finish teeth 42 are inclined so that the shell may be threadedly engaged on the finish by clockwise rotation of the shell with respect to the finish. Once fully seated, the finish teeth 42 act as rachet teeth and the shell teeth 38 each act as a pawl preventing disengagement of the shell from the finish by counter clockwise rotation. Thus, the engagement of shell 1 on container finish 39 has been rendered child-proof.

As an additional safety precaution and to protect the dispensing closure of the present invention from damage or dirt, it is within the scope of the invention to provide an overcap. Such an overcap is illustrated at 43 in FIGS. 14 through 16. The overcap has a top portion 44 and a downwardly depending skirt portion 45. The overcap is molded from a resilient plastic material such as, for example, polyethylene. The skirt 45 is elipical in cross section and normally has an inside dimension along the minor axis slightly less than the outside diameter of the lowermost part of the shell annular portion 3. In its normal condition the skirt portion 45 of the overcap 43 has an internal dimension along its major axis slightly greater than the outside diameter of the lower edge of the annular portion 3 of shell 1.

Figure 16:
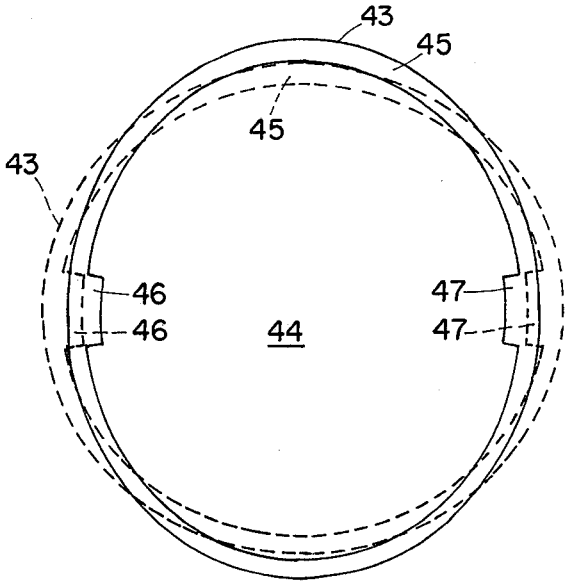
FIG. 16 is a bottom view of the overcap of FIG. 14 illustrating its normal configuration in solid lines and its distorted configuration for removal in broken lines.

Positioned at its minor axis the skirt portion 45 of the overcap 43 has a pair of diametrically opposed lugs 46 and 47. By virtue of its elipitical configuration, the skirt portion of overcap 43 may be forced downwardly about the shell 1 until diametrically opposed lugs 46 and 47 snap under the bottom edge of the shell annular portion 3. The lugs 46 and 47 will retain the overcap in position over the dispensing closure of the present invention as shown in FIGS. 14 and 15. To release overcap 43 from engagement with the shell 1, the overcap is grasped by the user at diametrically opposed positions along the major axis of the skirt portion 45. Upon squeezing the overcap, the lugs located along the minor axis will shift outwardly becoming disengaged from the bottom edge of the shell annular portion 3 so that the overcap may be lifted away from the dispensing closure. FIG. 16 is a diagramatic representation of the bottom edge of the skirt portion 45 of overcap 43. The bottom edge is shown in its normal configuration in solid lines and in its distorted configuration for removal in broken lines.

Figure 17:
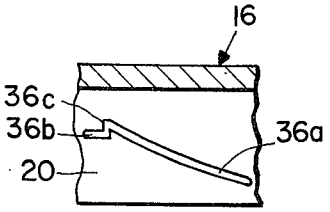
FIG. 17 is a fragmentary cross sectional view taken along section line 17—17 of FIG. 8 and illustrating another embodiment of a thread segment within the top of the present invention.

Finally, it is within the scope of the present invention to render the tip of the dispensing disclosure child-resistant. FIG. 17 is a fragmentary view, partly in cross section, taken along section lines 17—17 of FIG. 8 and illustrating a modified form of the thread segment 36, designated by index numeral **36*a*. The thread 36*a* differs from thread 36 of FIG. 8 only in that the uppermost portion of thread segment 36*a* is dropped slightly downwardly as at 36*b*, forming a shoulder 36*c*. When the tip 16 is shifted to its fully closed position, the thread 36*a* will ride in the notch 15*g* and relief 15*h* of post 15 and as the shoulder 36*c* is reached the dropped portion 36*b* of thread 36*a* will become engaged in the notch 15*g* and relief 15*h* of post 15. Further clockwise turning is, of course, precluded by abutment of the post 15 against tip web abutment surface 31*a*. Counter clockwise rotation of the tip to open it is precluded by abutment of the thread shoulder 36*c* against post 15. To turn the tip counter clockwise to its open position it is necessary to apply a downward force on the tip so that the upper portion of the groove 15*g* and the relief 15*h* of post 15 can override the thread shoulder 36*c*. In this embodiment it will be understood that the diametrically opposed tip thread 37 will be similarly configured and will react similarly with shell post 14. Excellent results may be achieved when thread portion 36*b* underlies the thread 36*a*** by about one thread width.

While not necessarily so limited, the various embodiments of the dispensing closure of the present invention have worked well and positively when the reliefs **14*h* and 15*h* on posts 14 and 15 were oriented at an angle of about 18° to the horizontal and the inclined planes 34 and 35 and the thread segments 36 and 37 were configured to lie at an angle of about 23° to the horizontal. When used to dispense thixotropic abrasive, liquid cleansers of the type described above, the dispensing closure of the present invention has proved to be non-spurting and durable. The dispensing closure is very simple to operate since only a small amount of twist is required to shift the tip between its open and closed positions and these positions are positively determined by the interaction of the shell posts 14 and 15 and the tip web stop surfaces 28*a* through 31*a***.

Modifications may be made in the invention without departing from the spirit of it.

The embodiments of the invention in which an exclusive property or privilege is claimed are defined as follows:

1. A two-piece, non-spurting dispensing closure for a container of the type having a finish, said closure comprising a shell and a tip, said shell having a top portion and an annular skirt for surrounding said container finish, means for attaching said skirt to said container finish, an upstanding cylindrical chimney being located centrally of said top portion of said shell, said chimney having a dispensing passageway extending axially therethrough and through said top portion of said shell, a cylindrical plug, means for supporting said plug axially and at the upper end of said chimney so as to extend thereabove, a pair of upstanding diametrically opposed posts located on said top portion of said shell to either side of and spaced from said chimney, each of said posts having a thread-receiving groove opening away from said chimney, said tip comprising a top portion and a downwardly depending skirt portion, said top portion of said tip having a dispensing opening located centrally thereof and passing therethrough, said tip having a cylindrical wall surrounding said dispensing opening and depending downwardly from said top portion thereof, said cylindrical wall surrounding said shell chimney and having an inside diameter so sized as to be rotatable about and axially shiftable with respect to said shell chimney, a pair of diametrically opposed inclined planes to either side of said cylindrical wall, each of said inclined planes contacting an upper edge of one of said shell posts, a pair of thread segments located on diametrically opposed inside surface portions of said tip skirt, each of said thread segments paralleling and being spaced from one of said inclined planes and being engaged in said groove of one of said shell posts whereby when said tip is twisted relative to said shell in one direction each of said shell posts cooperates with its respective tip thread segment and inclined plane to elevate said tip with respect to said shell from a retracted closed position wherein said plug is located in and closes said tip dispensing opening to an extended open position wherein said plug is withdrawn from said tip dispensing opening and when said tip is twisted relative to said shell in an opposite direction each of said posts cooperates with its respective thread segment and inclined plane to lower said tip with respect to said shell from said extended open position to said retracted closed position.

2. The structure claimed in claim 1 including an annular groove in the exterior surface of said chimney, an annular retaining rib on the interior surface of said tip cylindrical wall, said retaining rib being received within said chimney groove, said chimney groove being of such width that said retaining rib shifts therein as said tip is elevated and lowered between said open and closed positions whereby said retaining rib and said chimney groove cooperate to prevent inadvertant removal of said tip from said shell by a vertical pulling force.

3. The structure claimed in claim 1 including at least one sealing rib on the inside surface of said tip cylindrical wall, said sealing rib being so positioned as to contact and make a fluid-tight seal with the exterior surface of said shell chimney for all positions of said tip with respect to said shell.

4. The structure claimed in claim 1 including stop means on said tip positioned to cooperate with said shell posts to positively determine said open and said closed positions of said tip.

5. The structure claimed in claim 1 including a hollow overcap for said dispensing closure, said overcap comprising a top portion and a downwardly depending flexible skirt, said skirt normally having an elliptical cross section with a minor axis and a major axis, said skirt normally having an inside dimension along said minor axis of a length less than the diameter of the bottom edge of said shell skirt and an inside dimension along said major axis greater than said diameter of the bottom edge of said shell skirt, a pair of inturned opposed lugs located on the bottom edge of said overcap skirt at said minor axis thereof, said overcap skirt being distortable such that said overcap may be forced downwardly over said dispensing closure until said lugs snap beneath the bottom edge of said shell skirt, said overcap skirt being distortable by pressure applied at opposed positions of said skirt at said major axis thereof to increase the distance between said lugs to disengage said lugs from the bottom edge of said shell skirt for removal of said overcap.

6. The structure claimed in claim 1 wherein said shell skirt is internally threaded for attachment to a threaded container finish, a plurality of inclined teeth about the inside surface of said shell skirt at the bottom thereof, said inclined teeth each being so configured as to act as a pawl with respect to oppositely oriented ratchet-like teeth on said container finish to permit threaded engagement of said shell skirt on said bottle finish and to preclude disengagement of said shell skirt from said container finish.

7. The structure claimed in claim 1 including means on said tip for latching said tip in said closed position and requiring a combined push and twist movement of said tip with respect to said shell to unlatch said tip for movement to said open position whereby to render said dispensing closure child-resistant.

8. The structure claimed in claim 4 wherein said stop means comprise two pairs of diametrically opposed radial webs extending from said cylindrical tip wall to said tip skirt, the webs of one of said pairs thereof being so positioned as to each abut one of said shell posts to determine said open position of said tip and the webs of the other of said pairs thereof being so positioned as to each abut one of said shell posts to determine said closed position of said tip.

9. The structure claimed in claim 5 wherein said shell skirt is internally threaded for attachment to a threaded container finish, a plurality of inclined teeth about the inside surface of said shell skirt at the bottom thereof, said inclined teeth each being so configured as to act as a pawl with respect to oppositely oriented ratchet-like teeth on said container finish to permit threaded engagement of said shell skirt on said bottle finish and to preclude disengagement of said shell skirt from said container finish.

10. The structure claimed in claim 7 wherein that portion of each of said tip thread segments engaged in its respective one of said shell post grooves when said tip is in said closed position is stepped slightly downwardly from the adjacent portion of that thread segment forming a shoulder therebetween, said shoulders comprising said latching means.

11. The structure claimed in claim 10, wherein said shell skirt is internally threaded for attachment to a threaded container finish, a plurality of inclined teeth about the inside surface of said shell skirt at the bottom thereof, said inclined teeth each being so configured as to act as a pawl with respect to oppositely oriented ratchet-like teeth on said container finish to permit threaded engagement of said shell skirt on said bottle finish and to preclude disengagement of said shell skirt from said container finish.

12. The structure claimed in claim 11 including a hollow overcap for said dispensing closure, said overcap comprising a top portion and a downwardly depending flexible skirt, said skirt normally having an elliptical cross section with a minor axis and a major axis, said skirt normally having an inside dimension along said minor axis of a length less than the diameter of the bottom edge of said shell skirt and an inside dimension along said major axis greater than said diameter of the bottom edge of said shell skirt, a pair of inturned, opposed lugs located on the bottom edge of said overcap skirt at said minor axis thereof, said overcap skirt being distortable such that said overcap may be forced downwardly over said dispensing closure until said lugs snap beneath the bottom edge of said shell skirt, said overcap skirt being distortable by pressure applied at opposed positions of said skirt at said major axis thereof to increase the distance between said lugs to disengage said lugs from the bottom edge of said shell skirt for removal of said overcap.

* * * * *